US007393420B2

(12) United States Patent
Daito et al.

(10) Patent No.: US 7,393,420 B2
(45) Date of Patent: Jul. 1, 2008

(54) STEEL TUBE FOR BEARING ELEMENT PARTS AND METHOD OF MANUFACTURING AS WELL AS MACHINING THE SAME

(75) Inventors: Yoshihiro Daito, Kitakyushu (JP); Takashi Nakashima, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 397 days.

(21) Appl. No.: 11/191,914

(22) Filed: Jul. 29, 2005

(65) Prior Publication Data

US 2005/0279431 A1 Dec. 22, 2005

Related U.S. Application Data

(63) Continuation of application No. PCT/JP2004/000786, filed on Jan. 28, 2004.

(30) Foreign Application Priority Data

Jan. 30, 2003 (JP) ..... 2003-022111

(51) Int. Cl.
*C22C 38/18* (2006.01)
*C21D 8/10* (2006.01)

(52) U.S. Cl. ..... 148/333; 148/334; 148/335; 148/320; 148/590; 148/593; 148/651; 148/659; 148/909; 384/912

(58) Field of Classification Search ..... 148/333–335, 148/320, 590, 593, 651, 659, 909; 420/104–114; 384/912.625, 912

See application file for complete search history.

(56) References Cited

U.S. PATENT DOCUMENTS 6,162,390 A 12/2000 Bellus et al.

FOREIGN PATENT DOCUMENTS

JP 01-255651 10/1989

(Continued)

OTHER PUBLICATIONS

English abstract of Japanese patent 411325058, Yuji Nakamura et al. Nov. 26, 1999.*
Computer-generated English translation of Japanese patent 2001-294972 , Ofuji Yoshihiro, Oct. 26, 2001.*
Computer-generated English translation of Japanese patent 10-183243, Kitano Shuhei, Jul. 14, 1998.*

*Primary Examiner*—Deborah Yee
(74) *Attorney, Agent, or Firm*—Clark & Brody

(57) ABSTRACT

Steel tubes for bearing element parts according to the present invention, wherein the specific compositions are limited and an accumulation intensity of {211} face along with an impact property at ambient temperature in the longitudinal direction of steel tube are specified, can be provided as a source material for bearing element parts, which have excellent machinability and fatigue life in rolling contact, being incorporated without adding a free-cutting element specifically nor without reducing productivity since the spheroidizing for the same annealing duration with that of conventional spheroidizing treatment can be applied. Accordingly, by applying a manufacturing method or a cutting-machining method according to the present invention, bearing element parts such as races, rollers and shafts can be produced with less cost and efficiently.

8 Claims, 6 Drawing Sheets

FOREIGN PATENT DOCUMENTS

| | | |
|---|---|---|
| JP | 03-056641 | 3/1991 |
| JP | 09-227991 | 9/1997 |
| JP | 10-183243 | 7/1998 |
| JP | 2001-049388 | 2/2001 |
| JP | 2001-294972 | 10/2001 |
| JP | 2002-275584 | 9/2002 |

* cited by examiner

STEEL TUBE FOR BEARING ELEMENT PARTS AND METHOD OF MANUFACTURING AS WELL AS MACHINING THE SAME

CROSS-REFERENCE TO RELATED APPLICATIONS

This application is a continuation of International Patent Application No. PCT/JP2004/000786, filed Jan. 28, 2004. This PCT application was not in English as published under PCT Article 21(2).

FIELD OF THE INVENTION

The present invention relates to steel tubes having excellent machinability to be used for bearing element parts, and relates to a method of manufacturing as well as machining the same. More specifically, it relates to steel tubes having excellent machinability that is suitable for use of bearing element parts such as races, shafts and rollers, and relates to a method of manufacturing as well as machining the same.

BACKGROUND ART

For source tubes for bearing element parts such as races, shafts, rollers, needles and balls, high Cr (chromium) bearing steel such as SUJ2, specified in JIS G 4805 Standard is widely used in general.

The above, the so-called "bearing steel", is subjected to processing by means of hot rolling and the like, and then to spheroidizing annealing for the purpose of softening, followed by processing such as cold rolling, cold drawing, cold forging and machining, which finally undergoes the heat treatment comprising quenching and tempering at low temperature, thus resulting in having desired mechanical properties.

Since, among the above processing steps, the machining step is costly, there is a growing demand for bearing steel having excellent machinability that will enable to enhance cutting-machining efficiency and extend tool life.

A free-cutting metal element (a metal element to act for enhancing machinability) such as Pb and S is well known to improve machinability when it is added independently or in combination with the other(s). However, bearings to be used for industrial machineries, automobiles or the like are subjected to repetitively high surface pressure. In this regard, the addition of above free-cutting element(s) will cause a fatigue life in rolling contact to substantially decrease.

Furthermore, the above free-cutting metal element generally causes hot workability to decrease, thereby becoming more of an issue that surface cracking and defects are likely to be generated during hot working process such as hot rolling for bearing steels.

For example, in Japanese Patent Application Publication No. 01-255651, high Si- low Cr bearing steel having excellent machinability, which contains REM (rare-earth metals) in chemical compositions, is disclosed. However, since REM is very likely to be oxidized, a yield in steel making is unstable and it is difficult in commercial operation to control the globular size of REM oxides and the state of dispersion morphology of the same, whereby the coarse REM oxides tend to be generated, and the generation of a large amount of REM oxides leads up to a substantial decrease of the fatigue life in rolling contact.

In Japanese Patent Application Publication No. 03-56641, a bearing steel having excellent machinability, which contains BN compounds in the chemical compositions that enhance the machinability without decreasing the fatigue life in rolling contact, is disclosed. However, since B has little solubility in the steel, its yield is unstable in the steel and its segregation is likely to be generated. Further, B causes a solidification startup temperature to markedly decrease, thereby ending up promoting a solidification segregation in association with B segregation. In addition, the decrease of solidification startup temperature amounts to a reduction of hot workability, thereby ending up in likely generation of surface cracking and defects during hot working process.

Accordingly, the bearing steel having a B content which is specified in the above Japanese Patent Application Publication No. 03-56641, namely 0.004-0.020% in weight, is not commercially and reliably processed to be bearing element parts.

In Japanese Patent No. 3245045, a bearing steel having excellent machinability as well as cold workability and a method for manufacturing the same is disclosed, wherein the number of carbides in the metal structure and the hardness are adjusted by the heat treatment to be applied under specific condition. However, in this annealing condition by above invention, a slow heating or an isothermally holding in its heat-up step is required. In this regard, the annealing time becomes longer, thus reducing the productivity.

Furthermore, since, in a continuous heat treatment furnace which is commercially used, the temperature in each zone is predetermined and the number of zones is limited either, it is difficult to perform annealing under the condition specified in above Japanese Patent No. 3245045, whereby restructuring or renewal of the continuous heat treatment furnace becomes necessary in order to carry out annealing under the specified condition, thus ending up in a cost increase.

The disclosed technologies above could at least provide a bearing steel tube having excellent machinability to be used for bearing element parts. But, as afore-mentioned, the productivity as well as quality will potentially become more of an issue.

SUMMARY OF THE INVENTION

The present invention was made in view of above status quo, and its object is to provide a steel tube having excellent machinability which is suitable for use of bearing element parts such as races, rollers and shafts, without particularly adding free-cutting metal elements or without reducing productivity by applying an ordinary annealing time of 10-20 hours or so which is similar to the conventional case. Further, it is also an object to provide a method of manufacturing as well as machining said steel tube.

The present inventors, to achieve the above object, have intensively investigated and studied on the microstructure, especially texture, as well as machinability of a steel tube for bearing element parts to be subjected to cutting-machining process, thereby ending up in findings described in (a)-(f) as below.

(a) In cutting-machining process, bearing steels in general have microstructure where the globular cementite is dispersed in matrix consisting of ferrite, and it turns out by precise observation of cross section of cutting chips that the ferrite is deformed by shearing but the cementite maintains globular shape without being deformed.

(b) From the above (a), it can be assumed that the machinability is enhanced by facilitating the deformation of ferrite, wherein either of {110} face, {211} face, or {311} face that are known as a slip plane of ferrite has only to be accumulated onto the plane to be machined, namely onto the plane in parallel with circumferential direction of the steel tube.

(c) In order to control the texture, the parameter in cold working of the steel tube, namely the reduction rate of the cross section area along with wall thickness in cold working of the steel tube has only to be adjusted, and the heat treatment shall be performed with the conditions for enabling to decrease the dislocation density and to deter the growth of ferrite grain size after cold working.

(d) By controlling the parameter of cold working and the conditions of the heat treatment, {211} texture grows in the plane in parallel with the circumferential direction of the steel tube, thereby the tool life is markedly enhanced in groove-cutting, lathe turning, screw-threading, cutoff by turning, and the like where the direction of principal component in cutting gets parallel with the circumferential direction of the steel tube.

(e) In order to secure good machinability, it is effective that the impact property which is deemed as the index of brittleness is specified since the brittleness favorably works, in addition to the effect by growing texture of {211} face onto the plane in parallel with the circumferential direction of the steel tube.

(f) Where the hardness of coating layer on a tool, to be used for cutting-machining of the steel tube having texture described in above (d) and (e), is specified to be a certain threshold value or more, the tool life results in further extension.

The present invention is consummated based on the above findings, and the gist resides in a steel tube for bearing element parts described in following (1)-(3), a method of manufacturing the same described in following (4), and a method of machining the same described in following (5).

(1) A steel tube for bearing element parts, comprising, in mass %, C: 0.6-1.1%, Si: 0.1-1.5%, Mn: 0.2-1.5%, Cr: 0.2-2.0%, S: 0.003-0.020%, Al: 0.005-0.05%, Mo: 0-0.5% and the balance of Fe along with impurities which are consisted of Ti: 0.003% or less, P: 0.02% or less, N: 0.012% or less and O (oxygen): 0.0015% or less, wherein the accumulation intensity of {211} face is 1.5 or more in the plane in parallel with the circumferential direction thereof (hereinafter referred to as "a first steel tube").

(2) A steel tube for bearing element parts in accordance with above (1), comprising Mo: 0.03-0.5 mass % (hereinafter referred to as "a second steel tube").

(3) A steel tube for bearing element parts in accordance with above (1) or (2), wherein an impact value in the longitudinal direction thereof at ambient temperature is 10 J/cm$^2$ or less (hereinafter referred to as "a third steel tube").

(4) A method of manufacturing the steel tube for bearing element parts in accordance with above (1) or (2), the method comprising the steps of spheroidizing annealing after hot rolling process, successive cold working in such a way that the cross-section area reduction rate of steel tube is in the range of 50-80% and the wall thickness reduction rate thereof is in the range of 30-70%, and heat treating where heating temperature is in the range of 680° C. and $A_1$ point and the duration is 5-40 minutes.

Here, $A_1$ point designates the value expressed by the formula as below, where the symbol of the metal element in it means the content, mass %, in the steel.

$$A_1 \text{ point } (^\circ \text{C.}) = 723 + 29\,\text{Si} - 11\,\text{Mn} + 17\,\text{Cr}$$

(5) A method of machining the steel tube for bearing element parts in accordance with any one of (1)-(3), wherein a cemented carbide chip with a coating layer having 3000 or more in Vicker's Hardness is applied.

FIG. 1 is a diagram explaining "a plane in parallel with the circumferential direction of the steel tube". As shown in it, the "plane in parallel with the circumferential direction of the steel tube" according to the present invention is defined to be "a plane in parallel with the plane forming outer surface of steel tube in the specimen 2 that is flattened out for correcting the curvature of the halved steel tube 1 which is obtained by longitudinally splitting a ring-like steel tube, which is made by ring-cutting, and a plane positioned at 0.3 mm or more away from either plane forming outer surface or inner surface of the steel tube".

In this regard, the region less than 0.3 mm away from with either plane which forms an outer surface or inner surface is excluded for the reason that an anomalous layer such as a decarburized layer occasionally exists in that region.

Concurrently, "an accumulation intensity of {211} face" according to the present invention designates the quotient of an integrated reflection intensity of {211} face divided by 1700 (cps), wherein the intensity is measured for the plane in parallel with the circumferential direction of steel tube as defined above by X-ray diffraction method with the parameters described in (i)-(vi) as below (hereinafter referred to as "the specific X-ray diffraction method"):

(i) Apparatus: RU200 made by Rigaku-denki,
(ii) Emission source: Mo,
(iii) Voltage: 30 kV,
(iv) Electric current: 100 mA,
(v) Scan speed: 1 degree /min, and
(vi) Measurement range: 20 mm.

The divisor 1700 (cps) set forth as above is the value of the integrated reflection intensity of {211} face obtained by measurement in accordance with the above specific X-ray diffraction method for a polished specimen (hereinafter referred to as "Standard Specimen") which is made in such a way that a hot forged bar of 60 mm in diameter made of Steel D shown in Table 1, described later on, is heated at 1200° C. for 30 min followed by cooling in the open air down to room temperature, heated again at 780° C. for 4 hours followed by step cooling comprising first stage cooling down to 660° C. with cooling rate of 10° C./hr and an immediate second cooling down to room temperature in the open air, and then the in-process bar is subjected to cutting and polishing for the cross-section of the round bar to be provided for measurement.

BEST MODE FOR CARRYING OUT THE INVENTION

Figure 1:
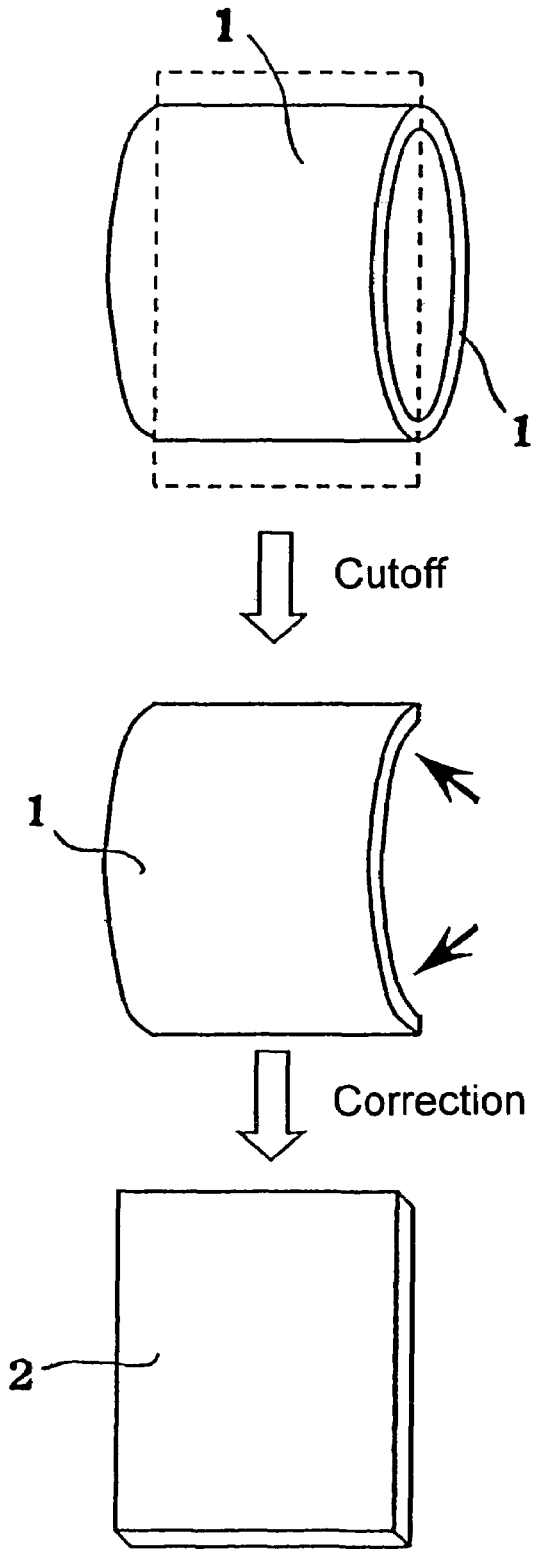
FIG. 1 is a diagram explaining "a plane in parallel with the circumferential direction of steel tube".

In the followings, what the present invention contains is recited by classifying into chemical compositions of steel tube, texture, impact property at ambient temperature, a manufacturing method and a chip for machining-cutting. Herein, % in the content of each metal element denotes "mass %".

(A) Chemical Compositions of Steel Tube

C: 0.6-1.1%

Desired mechanical properties are given to bearing steel materials (bearing element parts) by applying quenching and tempering at low temperature, but in case that C content is less than 0.6%, the obtained hardness after above quenching/tempering becomes low so that the required hardness for bearing element parts, that is, Rockwell C Hardness to be not less than 58, can not be achieved. On the other hand, in case C content exceeds 1.1%, the melting startup temperature of the steel decreases, thereby causing cracking and defects during hot tube making process to generate frequently. Thus, C content is specified to be in the range of 0.6-1.1%.

Si: 0.1-1.5%

Si is an effective element for enhancing a fatigue life in rolling contact and also an important element as a deoxidizer. Si has an effect to enhance quench hardenability of steel too. However, in case that the content thereof is less than 0.1%, the above effect can not be expected. On the other hand, in case that the content of Si exceeds 1.5%, it takes long time to descale after hot working process or spheroidizing annealing, thereby incurring substantial fall of productivity. Thus, Si content is specified to be in the range of 0.1-1.5%.

Mn: 0.2-1.5%

Mn serves to enhance quench hardenability of steel and is a required element to prevent hot embrittlement due to S element. To that end, Mn content shall be 0.2% or more. On the other hand, in case Mn content exceeds 1.0%, the center segregation of not only Mn but also C is induced to generate. In particular, Mn content exceeding 1.5% results in notable center segregation of Mn as well as C, which causes the melting startup temperature of steel to decrease, thereby ending up in frequent generation of cracking and defects during hot tube making process. Thus, Mn content is specified to be in the range of 0.2-1.5%. It is further preferable that Mn content is limited in the range of 0.2-1.0%.

Cr: 0.2-2.0%

Cr has an effect to enhance quench hardenability of steel. And Cr is very likely to be enriched in cementite, which thus causes cementite to be hardened by the Cr enrichment, thereby serving to enhance the machinability. However, Cr content below 0.2% is ineffective for the above aspect. On the other hand, in case the content exceeds 1.6%, the center segregation of not only Cr but also C is induced to generate. In particular, Cr content exceeding 2.0% results in marked center segregation of Cr as well as C, which causes the melting startup temperature of steel to decrease, thereby ending up in frequent generation of cracking and defects during hot tube making process. Thus, Cr content is specified to be in the range of 0.2-2.0%.

S: 0.003-0.020%

S combines with Mn to form MnS, wherein said MnS plays the role of lubrication in cutting-machining process, thereby enhancing a tool life. To that end, it is necessary that S content is 0.003% or more. On the other hand, in case S content exceeds 0.020%, the melting startup temperature of steel decreases, ending up in frequent generation of cracking and or defects during hot tube making process. Thus, S content is specified to be in the range of 0.003-0.020%.

Al: 0.005-0.05%

Since Al has a strong deoxidizing effect, it is an effective element to reduce oxygen content in steel. To that end, it is necessary that Al content is 0.005% or more. On the other hand, Al tends to form non-metallic inclusions, which causes a fatigue life in rolling-contact to decrease. In particular, in case the content exceeds 0.05%, significantly large non-metallic inclusions are likely to be formed, thereby resulting in marked reduction of a fatigue life in rolling-contact. Thus, Al content is specified to be in the range of 0.005-0.05%.

Mo: 0-0.5%

It is not necessary for Mo to be added. But by adding it, a fatigue life in rolling contact can be enhanced. To secure said effect, it is preferable that Mo content is 0.03% or more. Nonetheless, in case the content exceeds 0.5%, an excessive quench hardenability is obtained, which causes martensite to easily be formed after hot rolling process, namely after hot tube making process, thereby becoming a cause of generation of cracking.

Therefore, for "a first steel tube" according to the present invention, Mo content is specified to be in the range of 0-0.5%, and for "a second steel tube" according to the present invention, Mo content is specified to be in the range of 0.03-0.5%.

Ti, P, N and O (oxygen), which are deemed as impurities according to the present invention, are specified as below.

Ti: 0.003% or less

Ti combines with N to form TiN, which reduces a fatigue life in rolling contact. In particular, in case the content exceeds 0.003%, a fatigue life in rolling contact decrease markedly. Therefore, Ti content is specified to be 0.003% or less. Moreover, as it is generally desirable to reduce the Ti content in impurities as much as possible, it is much more preferable for Ti content to be 0.002% or less.

P: 0.02% or less

P segregates at grain boundaries and reduces the melting point of metal in the vicinity of grain boundaries. In particular, in case the content exceeds 0.02%, the melting point of metal in the vicinity of grain boundaries decreases significantly, thereby causing cracking and defects during hot tube making process to frequently generate. Therefore, P content is specified to be 0.02% or less. It is much more preferable for the P content to be 0.01% or less.

N: 0.012% or less

N likely combines with Ti and Al to form TiN and AlN. As N content increases and large TiN and AlN is formed, a fatigue life in rolling contact reduces. In particular, in case the content exceeds 0.012%, the fatigue life in rolling contact reduces markedly. Therefore, N content is specified to be 0.012% or less.

O (oxygen): 0.0015% or less

O (oxygen) forms oxide-type inclusions, which reduces a fatigue life in rolling contact. In particular, in case the content exceeds 0.0015%, the fatigue life in rolling contact reduces markedly. Therefore, O content is specified to be 0.0015% or less. It is desirable for O content to be as low as possible, thus it is preferable for the content to be 0.0010% or less.

In a steel tube for bearing element parts according to the present invention, the chemical compositions besides above metal elements could comprises, for example, Ni: 1% or less, Cu: 0.5% or less, V: 0.1% or less, Nb: 0.05% or less, Ca: 0.003% or less and Mg: 0.003% or less so as to ensure a required feature as a finished product as well as to make it possible to obtain steel tubes having excellent machinability.

Furthermore, in case above-mentioned elements are supplementarily added into the chemical compositions in order to enhance the feature as finished products or to enhance the machinability of steel tubes, it is preferable for these elements to be respectively limited as specified by Ni: 0.1-1%, Cu: 0.05-0.5%, V: 0.02-0.1%, Nb: 0.005-0.05%, Ca: 0.0003-0.003% and Mg: 0.0003-0.003%.

In this regard, among above-mentioned elements, Ni, Cu, V and Nb can be added in combination, not to mention independently. Also, Ca and Mg can be added in combination, not to mention independently. Further, at least one element out of Ni, Cu, V and Nb can be added in combination with either or both of Ca and Mg.

(B) Texture

An accumulation intensity of {211} face in the plane in parallel with the circumferential direction of steel tube correlates with a tool life in cutting-machining, and a satisfactory tool life can be assured when the above accumulation intensity of {211} face in the plane in parallel with the circumferential direction becomes 1.5 or more.

As recited in Examples later on, the present inventors cut steel tubes having various chemical compositions into rings of 20 mm in length, split these rings into halves on the plane in parallel with longitudinal direction, and then make these halves flattened to prepare flat specimens. Further, each surface of these specimens corresponding to the outer surface of steel tube is polished taking off the metal of about 0.5 mm depth to obtain a mirror finished surface, namely "a plane in parallel with the circumferential direction of steel tube", which is subsequently measured by use of an ordinary X-ray diffraction method to obtain each pole figure of (200) and (110), thereby determining face orientation of texture.

Consequently, as texture, there exist {211}<110>, {111}<211> and random one. Accordingly, with regard to {211} face or {111} face, an integrated reflection intensity is measured by afore-mentioned "Specific X-ray Diffraction Method" to obtain the specific ratio of the integrated reflection intensity thus measured to the intensity—which is set to be one (1)—for respective face in Standard Specimen. Hence, the obtained ratio of the integrated reflection intensity comes to be the accumulation intensity of the relevant face.

Further, to measure a tool life, groove-cutting by turning is applied onto the outer surface of steel tube in such a way that the chip described in (i) as below is used with the cutting parameter described in (ii) as below. Incidentally, either the number of cutting pass when the wear on relief face of the chip gets to 100 μm or more, or the number of cutting pass when the tip of the chip happens to fall off is sentenced to be a "Tool Life".

(i) Chip: The grade of the base metal is K10 grade of cemented carbides, and TiN coating (the hardness of the coated layer is 2200 in Vicker's Hardness) is applied on relief face only, wherein the rake angle is 10 degree, which is used for cutting the groove with 2.0 mm width and 0.1 mm of corner radius.

(ii) Cutting parameter: The parameter in cutting comprises a circumferential speed: 120 m/min, a feed rate: 0.050 mm per revolution, and a groove depth: 1.2 mm, which is defined as one pass, and the repeated passes are applied.

Figure 2:
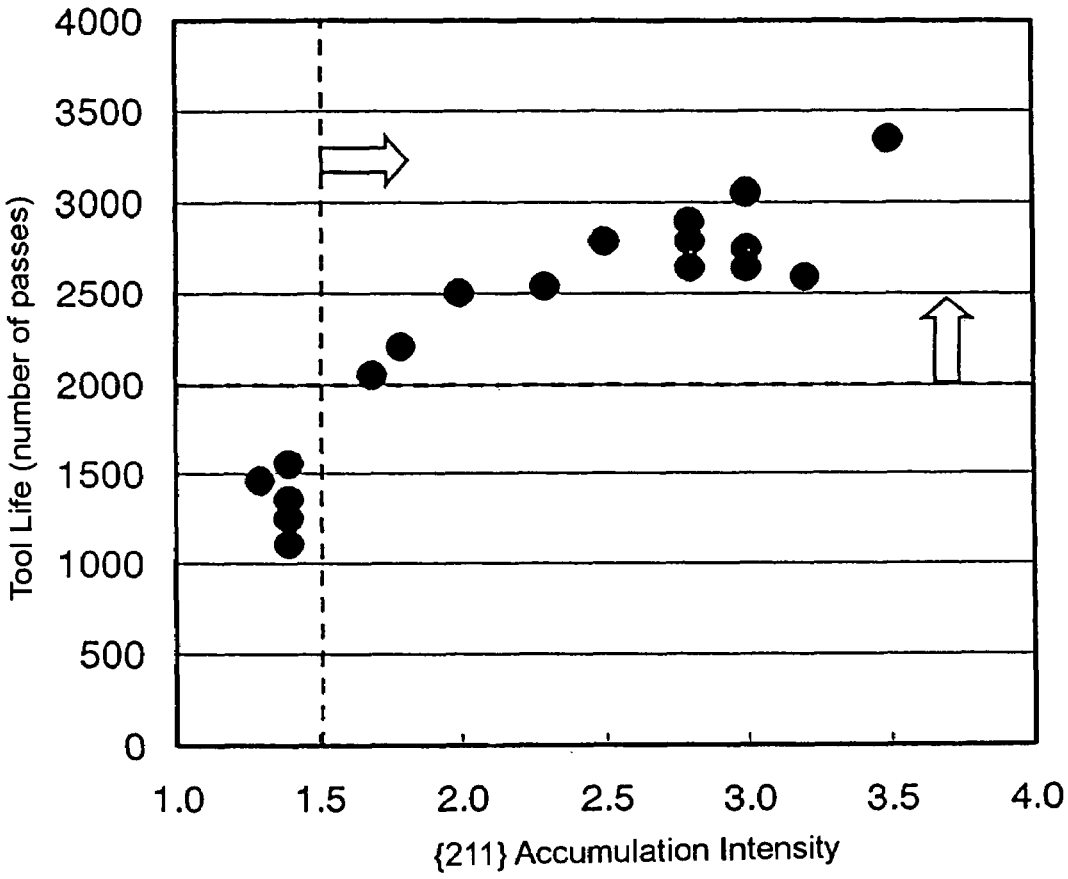
FIG. 2 is a diagram showing a relationship between a tool life and an accumulation intensity of {211} face onto "the plane in parallel with the circumferential direction of steel tube".

FIG. 2 is a diagram showing a relationship between a tool life and an accumulation intensity of {211} face in the plane in parallel with the circumferential direction of steel tube. Based on the relationship in FIG. 2, in case of "A First Steel Tube" according to the present invention, an accumulation intensity of {211} face in the plane in parallel with the circumferential direction of steel tube is specified to be 1.5 or more. Further, it is preferable for above accumulation intensity to be 2.0 or more.

The upper limit of the accumulation intensity of {211} face is not specifically set forth, but it costs a lot to achieve 4.0 or more under conditions for commercial mass production. For that reason, it is preferable for the accumulation intensity of {211} face to be less than 4.0.

Further, in case of "A First Steel Tube" according to the present invention, although it is not essential for normal axis orientation of {211} texture to be specifically set forth, it is preferable that {211}<110> orientation is prevalent.

(C) Impact Property at Ambient Temperature

Since cutting-machining operation is a kind of destruction, it is effective in ensuring machinability to grow texture in crystal face as in "A First Steel Tube" according to the present invention, and to make the crystal face orientation coordinate with a certain direction. Namely, by getting the crystal face orientation coordinated, the crystal face with specific orientation is only to be cut in comparison with the case the orientation is random, thereby enhancing machinability.

In this regard, since the brittleness of steel tube favorably serves for machinability, it is preferable for impact property, which is deemed as an index of brittleness, to be specified. Hence, in "A Third Steel Tube" according to the present invention, the impact value at ambient temperature is specified to be 10 J/cm$^2$ or less in addition to making the texture of {2 11} face grow in the plane in parallel with the circumferential direction of steel tube.

(D) Manufacturing Method

In order to obtain steel tubes for bearing element parts having excellent machinability, as being recited in above (B), it is essential that the accumulation intensity of {211} face in the plane in parallel with the circumferential direction of steel tube is 1.5 or more.

And in order to achieve 1.5 or more in accumulation intensity of {211} face in the plane in parallel with the circumferential direction of steel pipe, for example, it is fair enough that spheroidizing annealing is carried out after hot-rolling process, and cold working with 50-80% of cross-section area reduction rate along with 30-70% of wall thickness reduction rate in steel tube is applied, which is finally followed by heat treatment of heating at 680° C.-$A_1$ point and holding for 5-40 minutes.

Here, $A_1$ points designates the value expressed by the formula: $A_1$ point (° C.)=723+29Si−11 Mn+17 Cr, where the symbol of the metal element in it means the mass % in the steel, as described before.

Spheroidizing annealing is carried out for softening purpose after hot-rolling process, and a common spheroidizing annealing can be applied. As recited in Examples described later, the present inventors applied a common spheroidizing annealing after hot-rolling process for steel tubes having various chemical compositions, and then applied cold working process and heat treatment under various conditions to investigate the texture by the procedure described in (B) as above.

Figure 4:
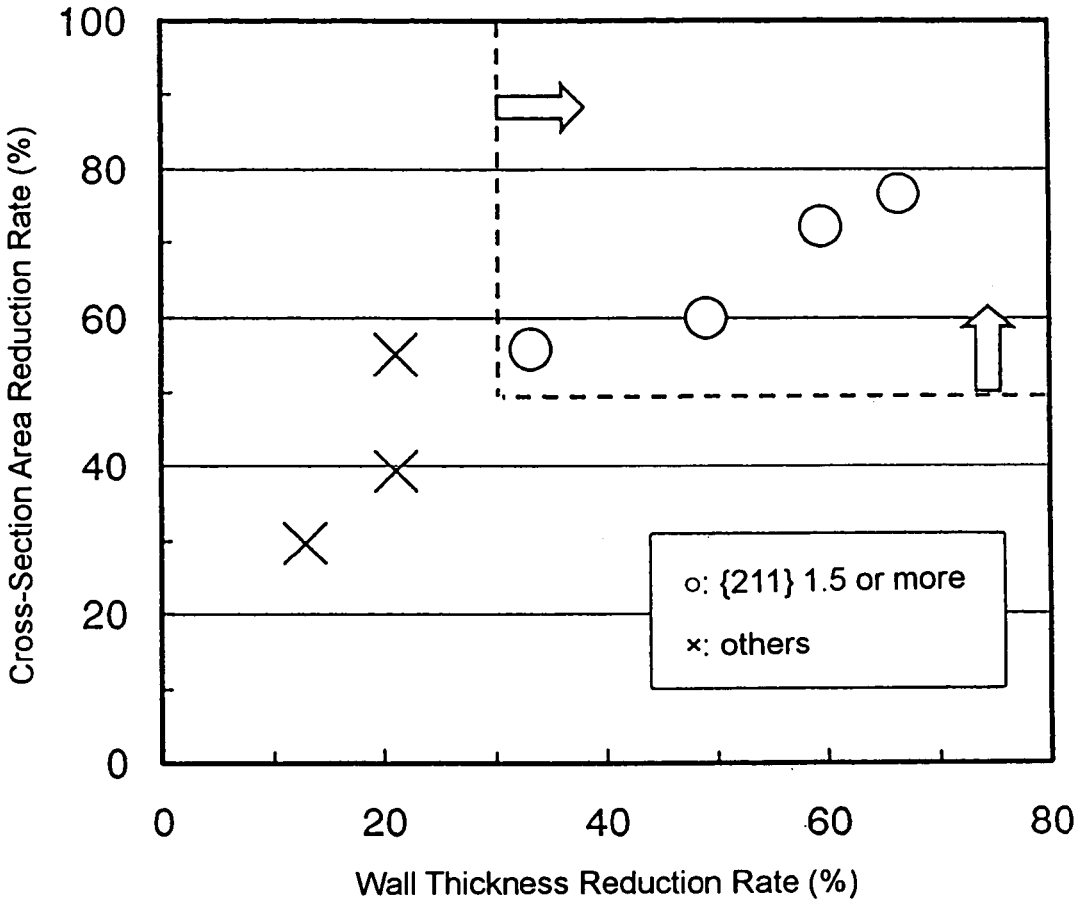
FIG. 4 is a diagram showing how the cross-section area reduction rate as well as the wall thickness reduction rate of steel tube affect the growth of {211} texture. In the diagram, a symbol ○ denotes the case that an obtained accumulation intensity of {211} face is 1.5 or more, and a symbol x denotes the case other than that (namely, an accumulation intensity of {211} face is less than 1.5) in above category.
Figure 5:
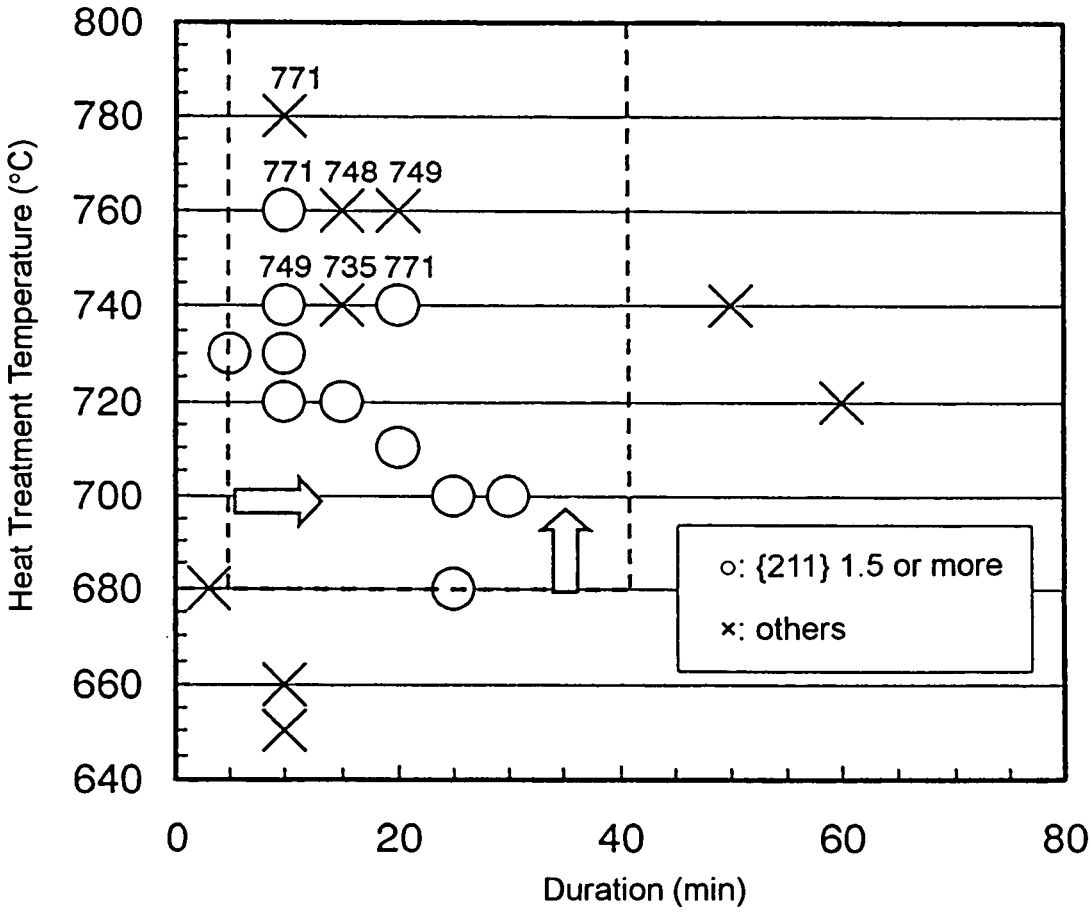
FIG. 5 is a diagram showing how the heat treatment temperature (heating temperature) and its holding time affect the growth of {211} texture. In the diagram, a symbol ○ denotes the case that an obtained accumulation intensity of {211} face is 1.5 or more, and a symbol x denotes the case other than that (namely, an accumulation intensity of {211} face is less than 1.5) in above category.

FIGS. 4 and 5 are obtained from the collation of some examples of the results by above investigation.

FIG. 4 is a diagram showing how the cross-section area reduction rate of steel tube as well as the wall thickness reduction rate of steel tube affect the growth of {211} texture. To be concrete, in the steps comprising a common spheroidizing annealing after hot-rolling process of steel tubes having chemical compositions conforming to the provisions described in above (A), cold working under various conditions, and subsequent heat treatment consisting of heating at 680° C.-$A_1$ point and holding for 5-40 minutes, the extent how the cross-section area reduction rate of steel tube as well as the wall thickness reduction rate of steel tube affect the growth of {211} texture is collated.

In the diagram, a symbol ○ denotes the case that an obtained accumulation intensity of {211} face is 1.5 or more, and a symbol x denotes the case other than that (namely, an accumulation intensity of {211} face is less than 1.5) in above category. By the way, in the diagram, the case the obtained accumulation intensity of {211} face is 1.5 or more is simply represented by {211} 1.5 or more.

As derived from above FIG. 4, it is obvious that, to achieve 1.5 or more of the accumulation intensity of {211} face, the cross-section reduction rate of steel tube (cross-section area reduction rate) has only to be 50% or more and the wall thickness reduction rate of steel tube has only to be 30% or more as a condition of cold working after spheroidizing annealing.

However, in case the cross-section reduction rate exceeds 80% for steel tube prior to cold working and or in case the wall thickness reduction rate of steel tube in cold working exceeds 70%, the productivity in cold working process decreases. Therefore, the upper limits of both cross-section reduction rate of steel tube and wall thickness reduction rate of steel tube are preferably specified to be 80% and 70% respectively.

FIG. 5 is a diagram showing how the heat treatment temperature (heating temperature) and its holding time affect the growth of {211} texture. To be concrete, in the steps comprising a common spheroidizing annealing after hot-rolling process of steel tubes having chemical compositions conforming to the provisions described in above (A), a cold working process in such a way as described before that the cross-section reduction rate of steel tube is 50-80% and the wall thickness reduction rate of steel tube is 30-70%, and subsequent heat treatment under various conditions, the extent how the heat treatment conditions, namely the heat treatment temperature and its holding time affect the growth of {211} texture is collated.

In the diagram, a symbol ○ denotes the case that an obtained accumulation intensity of {211} face is 1.5 or more, and a symbol × denotes the case other than that (namely, an accumulation intensity of {211} face is less than 1.5) in above category. Here, the numbers appearing on the top of ○ and × in case that the heating temperature is 740-780° C. and its holding time is 10-20 minutes denote $A_1$ points (° C.). By the way, in the diagram as before, the case the obtained accumulation intensity of {211} face is 1.5 or more is simply described by {211} 1.5 or more.

Being derived from above FIG. 5, it is apparent that, to achieve 1.5 or more of the accumulation intensity of {211} face, the treatment consisting of heating at 680° C.-$A_1$ point and holding for 5-40 minutes has only to be carried out after afore-mentioned cold working process.

Therefore, in manufacturing method according to the present invention, it is set forth that the method comprises the steps of spheroidizing annealing after hot-rolling process, cold working in such a way that the cross-section reduction rate of steel tube is 50-80% and the wall thickness reduction rate of steel tube is 30-70%, and subsequent heating at 680° C.-$A_1$ point for 5-40 minutes in duration.

(E) Chip for Cutting-machining

As recited in Examples described later, the present inventors applied hot-rolling process for steel having chemical compositions conforming to the provisions described in above (A), a common spheroidizing annealing after that, and then cold working process along with heat treatment with conditions conforming to the provisions described in above (D) to investigate the texture by the procedure described in above (B).

Further, the steel tube thus obtained is subjected to groove-cutting with same parameters as above (B) except the variation of a coating layer on the chip in order to measure a tool life.

There are three types of a coating layer onto relief face only of above cemented carbide chip, which are TiN, TiAlN, and a multi-laminated coating layer by depositing TiN and AlN alternately with a cycle of 2.5 nm, wherein each Vicker's Hardness is 2200, 3100 and 3900 respectively.

Figure 6:
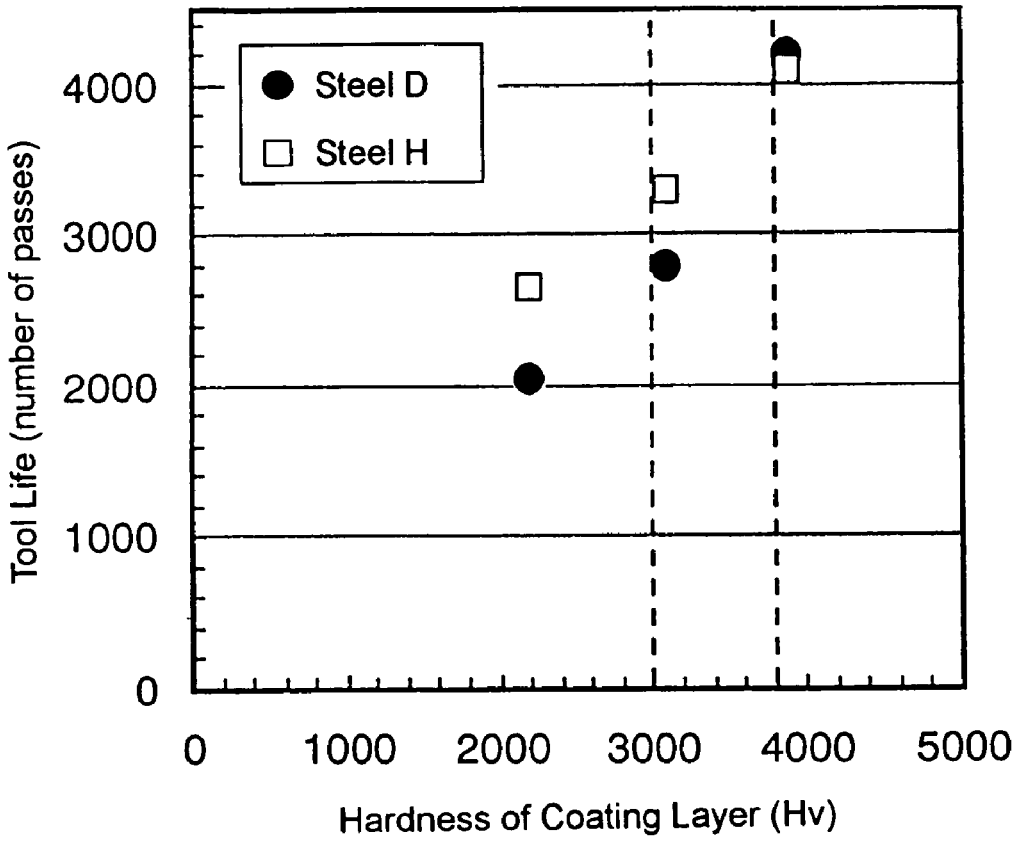
FIG. 6 is a diagram showing a relationship between a tool life and Vicker's Hardness of coating layer on a cemented carbide chip.

FIG. 6 is a diagram showing a relationship between a tool life and Vicker's Hardness of coating layer on a cemented carbide chip. From this diagram, it turns out that the cemented carbide chip having a coating layer with 3000 or more in Vicker's Hardness has only to be used in order to extend a tool life.

Therefore, in the cutting-machining method according to the present invention, it is set forth that the cemented carbide chip having a coating layer with 3000 or more in Vicker's Hardness be used for cutting-machining. Further, in case the Vicker's Hardness is 3800 or more, the tool life can be increasingly enhanced. Thus, it is more preferable that the cemented carbide chip having a coating layer with 3800 or more in Vicker's Hardness be used for cutting-machining.

Meanwhile, although the upper limit of the Vicker's Hardness is not specified in particular, it is costlier to form a coating layer with 4500 or more in Vicker's Hardness. For that reason, it is preferable that the Vicker's Hardness of the coating layer be less than 4500.

In the followings, based on Examples 1-3, the effects of the present invention are recited.

EXAMPLE 1

The Steels A-C and E-T with chemical compositions shown in Tables 1 and 2 were melted by a vacuum furnace with a capacity of 180 kg. And Steel D was melted by a converter with a capacity of 70 ton.

Steels B-D, Steel F, Steel H, Steel K and Steel M shown in above Tables 1 and 2 conform to the claimed ranges of chemical compositions according to the present invention. On the other hand, Steel A, Steel E, Steel G, Steel I, Steel J, Steel L and Steels N-T represent comparative examples, wherein any element(s) in chemical compositions falls out of the claimed ranges according to the present invention.

TABLE 1

| Classification | Steel | Chemical Compositions (mass %) C | Si | Mn | Cr | Mo | Residuals: Fe and Impurities Al | Ti | P | S | N | O | $A_1$ point (° C.) |
|---|---|---|---|---|---|---|---|---|---|---|---|---|---|
| C | A | *0.54 | 0.53 | 0.79 | 0.39 | — | 0.024 | 0.001 | 0.008 | 0.009 | 0.0071 | 0.0007 | 736 |
| I | B | 0.62 | 0.51 | 0.80 | 0.38 | — | 0.022 | 0.002 | 0.009 | 0.011 | 0.0074 | 0.0008 | 735 |
| I | C | 0.81 | 0.22 | 0.38 | 1.41 | 0.01 | 0.019 | 0.001 | 0.012 | 0.008 | 0.0059 | 0.0007 | 749 |
| I | D | 1.01 | 0.20 | 0.37 | 1.42 | 0.01 | 0.021 | 0.002 | 0.008 | 0.009 | 0.0053 | 0.0009 | 749 |
| C | E | *1.16 | 0.21 | 0.40 | 1.38 | — | 0.023 | 0.001 | 0.007 | 0.010 | 0.0059 | 0.0006 | 748 |
| I | F | 0.98 | 1.38 | 0.72 | 0.92 | — | 0.018 | 0.001 | 0.012 | 0.009 | 0.0062 | 0.0006 | 771 |
| C | G | 0.99 | *1.58 | 0.69 | 0.89 | — | 0.009 | 0.002 | 0.013 | 0.012 | 0.0075 | 0.0007 | 776 |
| I | H | 0.89 | 0.25 | 1.41 | 1.02 | 0.01 | 0.008 | 0.001 | 0.017 | 0.004 | 0.0084 | 0.0013 | 732 |
| C | I | 0.91 | 0.25 | *1.62 | 1.00 | 0.01 | 0.022 | 0.001 | 0.014 | 0.013 | 0.0081 | 0.0007 | 729 |
| C | J | 1.00 | 0.64 | 0.88 | *2.15 | — | 0.023 | 0.001 | 0.008 | 0.007 | 00079 | 0.0006 | 768 |

C and I denote "Comparative Example" and "Inventive Example" respectively.
$A_1$ point (° C.) = 723 + 29 Si (%) − 11 Mn (%) + 17 Cr (%)
A symbol * denotes the deviation from the claimed ranges according to the present invention.

TABLE 2

| Classification | Steel | Chemical Compositions (mass %) C | Si | Mn | Cr | Mo | Residuals: Fe and Impurities Al | Ti | P | S | N | O | $A_1$ point (° C.) |
|---|---|---|---|---|---|---|---|---|---|---|---|---|---|
| I | K | 1.01 | 0.21 | 0.39 | 1.39 | 0.13 | 0.020 | 0.003 | 0.009 | 0.017 | 0.0112 | 0.0005 | 748 |
| C | L | 0.99 | 0.58 | 0.94 | 1.03 | *0.59 | 0.019 | 0.001 | 0.007 | 0.011 | 0.0075 | 0.0007 | 747 |
| I | M | 1.00 | 0.24 | 0.34 | 1.38 | 0.02 | 0.043 | 0.001 | 0.008 | 0.009 | 0.0068 | 0.0008 | 750 |
| C | N | 0.98 | 0.25 | 0.36 | 1.40 | 0.01 | *0.058 | 0.001 | 0.009 | 0.009 | 0.0091 | 0.0006 | 750 |
| C | O | 0.99 | 0.23 | 0.41 | 1.42 | — | 0.021 | *0.004 | 0.013 | 0.008 | 0.0109 | 0.0008 | 749 |
| C | P | 1.01 | 0.21 | 0.35 | 1.36 | 0.01 | 0.024 | 0.002 | *0.024 | 0.012 | 0.0072 | 0.0009 | 748 |
| C | Q | 1.00 | 0.22 | 0.36 | 1.38 | 0.01 | 0.021 | 0.001 | 0.007 | *0.002 | 0.0056 | 0.0008 | 749 |
| C | R | 1.00 | 0.20 | 0.36 | 1.38 | 0.01 | 0.023 | 0.001 | 0.008 | *0.026 | 0.0075 | 0.0008 | 748 |
| C | S | 1.01 | 0.21 | 0.34 | 1.35 | 0.02 | 0.032 | 0.002 | 0.010 | 0.012 | *0.0134 | 0.0009 | 748 |
| C | T | 0.98 | 0.19 | 0.35 | 1.36 | 0.01 | 0.022 | 0.001 | 0.009 | 0.013 | 0.0062 | *0.0017 | 748 |

C and I denote "Comparative Example" and "Inventive Example" respectively.
$A_1$ point (° C.) = 723 + 29 Si (%) − 11 Mn (%) + 17 Cr (%)
A symbol * denotes the deviation from the claimed ranges according to the present invention.

Then, each ingot of above Steels A-C and E-T that were made by 180 kg furnace was hot forged by an ordinary method to be a bar of 60 mm in diameter. Meanwhile, the ingot of Steel D that was melted by a 70-ton converter was subjected to breakdown and hot forging processes to be a billet of 178 mm in diameter, followed by an ordinary hot forging process to produce a bar of 60 mm in diameter.

For each Steel, a 60 mm diameter bar was cut into pieces of 300 mm in length, which were then subjected to spheroidizing annealing with various conditions. Regarding the conditions of spheroidizng annealing, in case that Cr content is 0.8% or more, the bars were heated at 780° C. for four hours, while in case that Cr content is less than 0.8%, those were heated at 760° C. for four hours. In either case, after heating for four hours, the bars were cooled at a rate of 10° C./hr down to 660° C. and then released to the open air.

The bars thus treated by spheroidizing annealing were subjected to machining to produce test specimens of 58 mm diameter by 5.2 mm thickness, which were heated at 820° C. for 30 min followed by immediate oil quenching and subsequent tempering at 160° C. for one hour.

Those test specimens (58 mm diameter, 5.2 mm thickness) that were subjected to quenching and tempering as above were mirror polished and underwent a fatigue test in rolling contact. The conditions of the fatigue test in rolling contact are shown in (i)-(v) as below.

(i) Test apparatus: Mori-type thrust system rolling contact fatigue test machine (ii) Maximum surface pressure: 5000 MPa (iii) Number of revolution of test specimens: 1800 rpm (iv) Lubricant: #68 Turbine Oil (v) Number of test specimens: 10 each The results of rolling contact fatigue test for ten (10) test specimens of each Steel are plotted on a Weibull probability plotting paper where an ordinate represents cumulative failure rate probability and an abscissa represents a fatigue life in rolling contact, thereby a linear analog is drawn to obtain a fatigue life ($L_{10}$ endurance limit in fatigue life) where a cumulative failure rate probability comes to be 10%. The target of $L_{10}$ endurance limit is set to be $1\times10^7$ or more and the steel whose $L_{10}$ endurance limit is below $1\times10^7$ is considered to have insufficient fatigue life in rolling contact, thus various tests, described later on, are not carried out for it.

Table 3 shows the result of rolling contact fatigue tests.

TABLE 3

| Classification | Test No. | Steel | Fatigue Life in Rolling Contact (cycles) |
|---|---|---|---|
| C | 1 | *A | # $4.5\times10^6$ |
| I | 2 | B | $1.3\times10^7$ |
| I | 3 | C | $1.9\times10^7$ |
| I | 4 | D | $3.7\times10^7$ |
| C | 5 | *E | $2.3\times10^7$ |
| I | 6 | F | $4.6\times10^7$ |
| C | 7 | *G | $5.1\times10^7$ |
| I | 8 | H | $1.2\times10^7$ |
| C | 9 | *I | $3.2\times10^7$ |
| C | 10 | *J | $3.5\times10^7$ |
| I | 11 | K | $4.9\times10^7$ |
| C | 12 | *L | $6.0\times10^7$ |

TABLE 3-continued

| Classification | Test No. | Steel | Fatigue Life in Rolling Contact (cycles) |
|---|---|---|---|
| I | 13 | M | $1.8 \times 10^7$ |
| C | 14 | *N | # $8.4 \times 10^6$ |
| C | 15 | *O | # $6.3 \times 10^6$ |
| C | 16 | *P | $1.9 \times 10^7$ |
| C | 17 | *Q | $4.1 \times 10^7$ |
| C | 18 | *R | $2.7 \times 10^7$ |
| C | 19 | *S | # $7.5 \times 10^6$ |
| C | 20 | *T | # $5.3 \times 10^6$ |

C and I denote "Comparative Example" and "Inventive Example" respectively.
A symbol * denotes the steel whose chemical compositions deviate from the claimed ranges according to the present invention.
A symbol # denotes that the target is not cleared.

From Table 3, it is apparent that Test No. 1 of Steel A having C content below the specified value, and Test Nos. 14, 15, 19 and 20 which are conducted for Steels N, O, S and T respectively where Al, Ti, N and O exceed the specified limit by the present invention respectively, do not satisfy the target of $L_{10}$ endurance limit, $1\times10^7$, thereby proving to have an inferior fatigue life in rolling contact.

Next, for Steels that have $L_{10}$ endurance limit not less than targeted $1\times10^7$ in the rolling contact fatigue test, the round bar of 60 mm in diameter as hot forged is heated at 1200° C. for 20 minutes and subjected to hot tube making process with finishing temperature of 850-950° C. to obtain 39.1 mm diameter by 5.90 mm wall thickness, finally being cooled down in the open air after hot tube making process.

In the inside surface of steel tube, the temperature thereof rises by heat generation by deformation itself during hot tube making process, and likely exceeds the melting point locally, which is attributed to likely generation of defects. In this regard, the inside surface of the obtained steel tube of 39.1 mm diameter by 5.90 mm wall thickness is inspected visually for defects. Furthermore, the visual inspection is also carried out to check whether or not cracking generate on both outside and inside surface.

Table 4 shows the inspection results of inside surface for defects as well as of both outside diameter and inside diameter for the presence of cracking.

From the result of Table 4 shown in next page, it is recognized that, in Test Nos. 24, 28, 29, 33 and 35 using Steels E, I, J, P and R respectively where C, Mn, Cr, P, and S exceed the specified value by the present invention respectively, the inside surface defects attributable to local melting are observed for either of steel tubes, thus proving to be an inferior surface feature. When defects are present, the cost for surface conditioning rises, thus making it difficult to apply for mass production. Therefore, any further tests are not conducted for above Steels.

In Test No. 31 using Steel L where Mo exceeds the specified value by the present invention, the ductility markedly decreases due to the formation of martensite, thereby causing cracking to generate. Therefore, subsequent tests are halted for Steel L either.

TABLE 4

| Classification | Test No. | Steel | Presence of Defects in Inside Surface of Steel Tube | Presence of Cracking in Outside and Inside Surfaces | Remaining Scale after Acid Pickling |
|---|---|---|---|---|---|
| I | 21 | B | No | No | No |
| I | 22 | C | No | No | No |
| I | 23 | D | No | No | No |
| C | 24 | *E | # Yes | No | — |

TABLE 4-continued

| Classification | Test No. | Steel | Presence of Defects in Inside Surface of Steel Tube | Presence of Cracking in Outside and Inside Surfaces | Remaining Scale after Acid Pickling |
|---|---|---|---|---|---|
| I | 25 | F | No | No | No |
| C | 26 | *G | No | No | # Yes |
| I | 27 | H | No | No | No |
| C | 28 | *I | # Yes | No | — |
| C | 29 | *J | # Yes | No | — |
| I | 30 | K | No | No | No |
| C | 31 | *L | No | # Yes | — |
| I | 32 | M | No | No | No |
| C | 33 | *P | # Yes | No | — |
| C | 34 | *Q | No | No | No |
| C | 35 | *R | # Yes | No | — |

I and C denote "Inventive Example" and "Comparative Example" respectively.
"—" in the column of Remaining Scale after Acid Pickling denotes that descaling by acid pickling is not performed.
A symbol * denotes the deviation from the claimed ranges of chemical compositions according to the present invention.
A symbol # denotes that the target is not cleared.

Accordingly, steel tubes made of Steels B-D, F, G, H, K, M and Q, where neither any inside surface defect nor any cracking on both outside and inside surfaces are detected, are subjected to descaling treatment by an ordinary acid pickling, to check whether or not any scale remains. In above Table 4, the presence of remaining scale is also listed.

As shown in Table 4, in case of Test No. 26 using Steel G whose Si content exceeds the specified value by the present invention, the scale can not be removed thoroughly by acid pickling, thus being left behind partly.

When the scale remains, the surface quality after cold working becomes unsatisfactory and the life of a tool for cold working gets short. Therefore, no further test is performed for Steel G.

Next, for Steels B-D, F H, K, M and Q where the obtained $L_{10}$ endurance limit is not less than $1\times10^7$, neither any inside surface defect nor any cracking on both outside and inside surfaces is detected for steel tubes made of said Steels, and no scale remains after descaling by an ordinary pickling, the round bar of 60 mm in diameter as hot forged is heated at 1200° C. for 20 minutes and then subjected to hot tube making process with finishing temperature of 850-950° C. to obtain the steel tube of 37.0-52.0 mm in diameter by 3.80-7.40 mm in wall thickness, finally being cooled down in open air after hot tube making.

Steel tubes thus obtained are subjected to spheroidizing annealing and successive descaling by an ordinary acid pickling, followed by cold drawing or cold rolling with cold pilger mill to obtain steel tubes of 30.0 mm in diameter by 3.0 mm in wall thickness.

The above spheroidizing annealing is carried out in heating at 780° C. for 4 hours in case of Steel whose Cr content is 0.8% or more, and at 760° C. for 4 hours in case of Steel whose Cr content is less than 0.8%. The cooling rate in both cases is 10° C./hour down to 660° C. and then released in the open air.

For the steel tubes subjected above cold drawing or cold rolling with Cold Pilger mill, the heat treatment at 650-780° C. for 3-50 minutes duration by a common method is carried out and the measurement of texture as well as cutting-machining test is performed.

In Tables 5-7, the dimension of above steel tube after hot tube making, the parameter for cold working and the condition of heat treatment are listed. Incidentally, the accumulation intensity of {211} face is described as {211} accumulation intensity and so is {111} accumulation intensity as for that of {111} face in these Tables.

TABLE 5

| | | | Dimension after Hot Tube Making | | Cold Working | | | | |
|---|---|---|---|---|---|---|---|---|---|
| | | | | | | Dimension after Cold Working | | Cross-section | Wall Thickness |
| Classification | Test No. | Steel | Outside Diameter (mm) | Wall Thickness | Method | Outside Diameter (mm) | Wall Thickness | Reduction Rate (%) | Reduction Rate (%) |
| C | 36 | B | 39.1 | 3.80 | Drawing | 30.00 | 3.00 | **39.5 | **21.1 |
| I | 37 | B | 39.1 | 5.90 | Rolling | 30.00 | 3.00 | 59.9 | 49.2 |
| C | 38 | B | 39.1 | 5.90 | Rolling | 30.00 | 3.00 | 59.9 | 49.2 |
| C | 39 | B | 45.0 | 7.40 | Rolling | 30.00 | 3.00 | 72.0 | 59.5 |
| C | 40 | C | 52.0 | 3.80 | Drawing | 30.00 | 3.00 | 55.1 | **21.1 |
| I | 41 | C | 45.0 | 7.40 | Rolling | 30.00 | 3.00 | 72.0 | 59.5 |
| I | 42 | C | 45.0 | 9.01 | Rolling | 30.00 | 3.00 | 76.6 | 66.7 |
| C | 43 | C | 45.0 | 9.01 | Rolling | 30.00 | 3.00 | 76.6 | 66.7 |
| C | 44 | D | 37.0 | 3.45 | Drawing | 30.00 | 3.00 | **29.7 | **13.0 |
| C | 45 | D | 39.1 | 3.80 | Drawing | 30.00 | 3.00 | **39.5 | **21.1 |
| C | 46 | D | 52.0 | 3.80 | Drawing | 30.00 | 3.00 | 55.1 | **21.1 |
| I | 47 | D | 45.0 | 4.51 | Rolling | 30.00 | 3.00 | 55.6 | 33.5 |
| I | 48 | D | 39.1 | 5.90 | Rolling | 30.00 | 3.00 | 59.9 | 49.2 |

| | Heat Treatment | | Texture | | | |
|---|---|---|---|---|---|---|
| Classification | Heating Temperature (° C.) | Duration (min) | Face Orientation random | {211} Accumulation Intensity | {111} Accumulation Intensity | Tool Life (number of passes) |
| C | 710 | 10 | {111} | *0.9 | 1.2 | # 750 |
| I | 710 | 20 | {211} | 2.0 | 0.8 | 2500 |
| C | 680 | **3 | {211} | *1.4 | 0.9 | # 1250 |
| C | **740 | 15 | random | *1.0 | 1.0 | # 400 |
| C | 720 | 15 | {111} | *1.1 | 1.6 | # 800 |
| I | 720 | 10 | {211} | 3.2 | 0.5 | 2600 |
| I | 740 | 10 | {211} | 3.5 | 0.4 | 3350 |
| C | 740 | **50 | {211} | *1.4 | 1.0 | # 1100 |
| C | 720 | 20 | {111} | *0.9 | 1.2 | # 900 |
| C | 720 | 15 | {111} | *0.9 | 1.3 | # 950 |
| C | 720 | 15 | {111} | *0.8 | 1.4 | # 1000 |
| I | 700 | 30 | {211} | 1.7 | 0.7 | 2050 |
| I | 720 | 15 | {211} | 2.8 | 0.6 | 2900 |

I and C in Classification column denote "Inventive Example" and "Comparative Example" respectively.
Rolling in Cold Working column means cold rolling with Cold Pilger mill.
A symbol * denotes the deviation from the specified provisions by the present invention.
A symbol ** denotes the deviation from the specified provisions in (3) by the present invention.
A symbol # denotes that the target is not cleared.

TABLE 6

| | | | Dimension after Hot Tube Making | | Cold Working | | | | |
|---|---|---|---|---|---|---|---|---|---|
| | | | | | | Dimension after Cold Working | | Cross-section | Wall Thickness |
| Classification | Test No. | Steel | Outside Diameter (mm) | Wall Thickness | Method | Outside Diameter (mm) | Wall Thickness | Reduction Rate (%) | Reduction Rate (%) |
| C | 49 | D | 39.1 | 5.90 | Rolling | 30.00 | 3.00 | 59.9 | 49.2 |
| I | 50 | D | 45.0 | 7.40 | Rolling | 30.00 | 3.00 | 72.0 | 59.5 |
| C | 51 | D | 45.0 | 9.01 | Rolling | 30.00 | 3.00 | 76.6 | 66.7 |
| I | 52 | D | 45.0 | 9.01 | Rolling | 30.00 | 3.00 | 76.6 | 66.7 |
| C | 53 | F | 39.1 | 3.80 | Drawing | 30.00 | 3.00 | **39.5 | **21.1 |
| I | 54 | F | 39.1 | 5.90 | Rolling | 30.00 | 3.00 | 59.9 | 49.2 |
| I | 55 | F | 45.0 | 7.40 | Rolling | 30.00 | 3.00 | 72.0 | 59.5 |
| C | 56 | F | 45.0 | 9.01 | Rolling | 30.00 | 3.00 | 76.6 | 66.7 |
| C | 57 | H | 52.0 | 3.80 | Drawing | 30.00 | 3.00 | 55.1 | **21.1 |
| C | 58 | H | 52.0 | 3.80 | Drawing | 30.00 | 3.00 | 55.1 | **21.1 |
| I | 59 | H | 45.0 | 4.51 | Rolling | 30.00 | 3.00 | 55.6 | 33.5 |
| C | 60 | H | 45.0 | 9.01 | Rolling | 30.00 | 3.00 | 76.6 | 66.7 |

TABLE 6-continued

| | Heat Treatment | | Texture | | | |
|---|---|---|---|---|---|---|
| Classification | Heating Temperature (° C.) | Duration (min) | Face Orientation random | {211} Accumulation Intensity | {111} Accumulation Intensity | Tool Life (number of passes) |
| C | **650 | 10 | {211} | *1.4 | 0.9 | # 1350 |
| I | 700 | 25 | {211} | 3.0 | 0.4 | 3050 |
| C | **760 | 20 | random | *1.0 | 1.0 | # 650 |
| I | 730 | 5 | {211} | 2.8 | 0.5 | 2800 |
| C | 740 | 20 | random | *1.0 | 1.0 | # 700 |
| I | 740 | 20 | {211} | 2.3 | 0.7 | 2550 |
| I | 760 | 10 | {211} | 3.0 | 0.4 | 2750 |
| C | **780 | 10 | random | *1.0 | 1.0 | # 600 |
| C | **640 | 15 | {211} | *1.4 | 0.9 | # 1250 |
| C | 720 | 20 | {111} | *1.1 | 1.4 | # 900 |
| I | 700 | 30 | {211} | 2.8 | 0.5 | 2650 |
| C | 720 | **60 | {211} | *1.3 | 0.9 | # 1450 |

I and C in Classification column denote "Inventive Example" and "Comparative Example" respectively.
Rolling in Cold Working column means cold rolling with Cold Pilger mill.
A symbol * denotes the deviation from the specified provisions by the present invention.
A symbol ** denotes the deviation from the specified provisions in (3) by the present invention.
A symbol # denotes that the target is not cleared.

TABLE 7

| | | | | | Cold Working | | | | |
|---|---|---|---|---|---|---|---|---|---|
| | | | Dimension after Hot Tube Making | | | Dimension after Cold Working | | Cross-section | Wall Thickness |
| Classification | Test No. | Steel | Outside Diameter (mm) | Wall Thickness | Method | Outside Diameter (mm) | Wall Thickness | Reduction Rate (%) | Reduction Rate (%) |
| C | 61 | K | 39.1 | 3.80 | Drawing | 30.00 | 3.00 | **39.5 | **21.1 |
| C | 62 | K | 45.0 | 4.51 | Rolling | 30.00 | 3.00 | 55.6 | 33.5 |
| I | 63 | K | 45.0 | 7.40 | Rolling | 30.00 | 3.00 | 72.0 | 59.5 |
| C | 64 | K | 45.0 | 7.40 | Rolling | 30.00 | 3.00 | 72.0 | 59.5 |
| C | 65 | M | 37.0 | 3.45 | Drawing | 30.00 | 3.00 | **29.7 | **13.0 |
| C | 66 | M | 52.0 | 3.80 | Drawing | 30.00 | 3.00 | 55.1 | **21.1 |
| I | 67 | M | 45.0 | 4.51 | Rolling | 30.00 | 3.00 | 55.6 | 33.5 |
| I | 68 | M | 39.1 | 5.90 | Rolling | 30.00 | 3.00 | 59.9 | 49.2 |
| C | 69 | *Q | 39.1 | 3.80 | Drawing | 30.00 | 3.00 | **39.5 | **21.1 |
| C | 70 | *Q | 45.0 | 4.51 | Rolling | 30.00 | 3.00 | 55.6 | 33.5 |
| C | 71 | *Q | 39.1 | 5.90 | Rolling | 30.00 | 3.00 | 59.9 | 49.2 |
| C | 72 | *Q | 45.0 | 7.40 | Rolling | 30.00 | 3.00 | 72.0 | 59.5 |

| | Heat Treatment | | Texture | | | |
|---|---|---|---|---|---|---|
| Classification | Heating Temperature (° C.) | Duration (min) | Face Orientation random | {211} Accumulation Intensity | {111} Accumulation Intensity | Tool Life (number of passes) |
| C | 720 | 15 | {111} | *0.8 | 1.6 | # 1050 |
| C | **660 | 10 | {211} | *1.4 | 0.8 | # 1550 |
| I | 730 | 10 | {211} | 3.0 | 0.5 | 2650 |
| C | **760 | 15 | random | *1.0 | 1.0 | # 450 |
| C | 720 | 15 | random | *1.0 | 1.0 | # 650 |
| C | 720 | 15 | {111} | *0.7 | 2.0 | # 1050 |
| I | 720 | 15 | {211} | 1.8 | 0.7 | 2200 |
| I | 720 | 15 | {211} | 2.5 | 0.6 | 2800 |
| C | **760 | 15 | random | *1.0 | 1.0 | # 350 |
| C | 680 | **3 | {211} | *1.4 | 0.8 | # 700 |
| C | 680 | 25 | {211} | 2.3 | 0.7 | # 1150 |
| C | 720 | 10 | {211} | 3.2 | 0.4 | # 1700 |

I and C in Classification column denote "Inventive Example" and "Comparative Example" respectively.
Rolling in Cold Working column means cold rolling with Cold Pilger mill.
A symbol * denotes the deviation from the specified provisions by the present invention.
A symbol ** denotes the deviation from the specified provisions in (3) by the present invention.
A symbol # denotes that the target is not cleared.

The texture of steel tube is measured by following procedure. Namely, steel tubes after heat treatment are cut into rings of 20 mm in length, which are successively split into halves on the plane in parallel with longitudinal direction. Then these halves are corrected to prepare flat test specimens (refer to FIG. 1), wherein the plane composing outside surface of steel tube is polished taking off the metal of about 0.5 mm depth to obtain a mirror finished surface, namely "a plane in parallel with the circumferential direction of steel tube", which is subsequently measured by use of an ordinary X-ray diffraction method to obtain each pole figure of (200) and (110), thereby determining face orientation of texture.

With regard to determined face orientation, an integrated reflection intensity is measured by afore-mentioned "Specific X-ray Diffraction Method", and the intensity thus measured is to be divided by the integrated reflection intensity for the same face orientation in case of "Standard Specimen", thereby obtaining an accumulation intensity of the relevant face.

As afore-mentioned, "Standard Specimen" denotes the specimen which is made in such a way that a hot forged bar of 60 mm in diameter made from Steel D shown in Table 1 is heated at 1200° C. for 30 min followed by cooling in the open air down to the room temperature, heated again at 780° C. for 4 hours followed by step cooling comprising first stage cooling down to 660° C. with cooling rate of 10° C./hr and an immediate second cooling down to the room temperature in the open air, and then the in-process bar is subjected to cutting and polishing for the cross-section of the round bar to be provided for measurement.

Also, the steel tubes after heat treatment are subjected to cutting-machining test for measuring the tool life in terms of groove-cutting under the conditions that a chip shown in (i) below is used and machining parameters shown in (ii) below are applied. In this regard, either the number of cutting pass when the wear on relief face of the chip gets to 100 μm or more, or the number of cutting pass when the tip of the chip happens to fall off is sentenced to be a "Tool Life". Incidentally, the target of the tool life is set to be 2000 passes or more in terms of a number of passes.

(i) Chip: The grade of the base metal is K10 grade of cemented carbides, and TiN coating (the hardness of the coated layer is 2200 in Vickers Hardness) is applied on relief face only, wherein the rake angle is 10 degree, which is used for cutting the groove with 2.0 mm width and 0.1 mm of corner radius.

(ii) Cutting parameter: The parameter in cutting comprises the circumferential speed: 120 m/min, the feed rate: 0.050 mm per revolution, and the groove depth: 1.2 mm, which is defined as one pass, and the repeated passes are applied.

Figure 3:
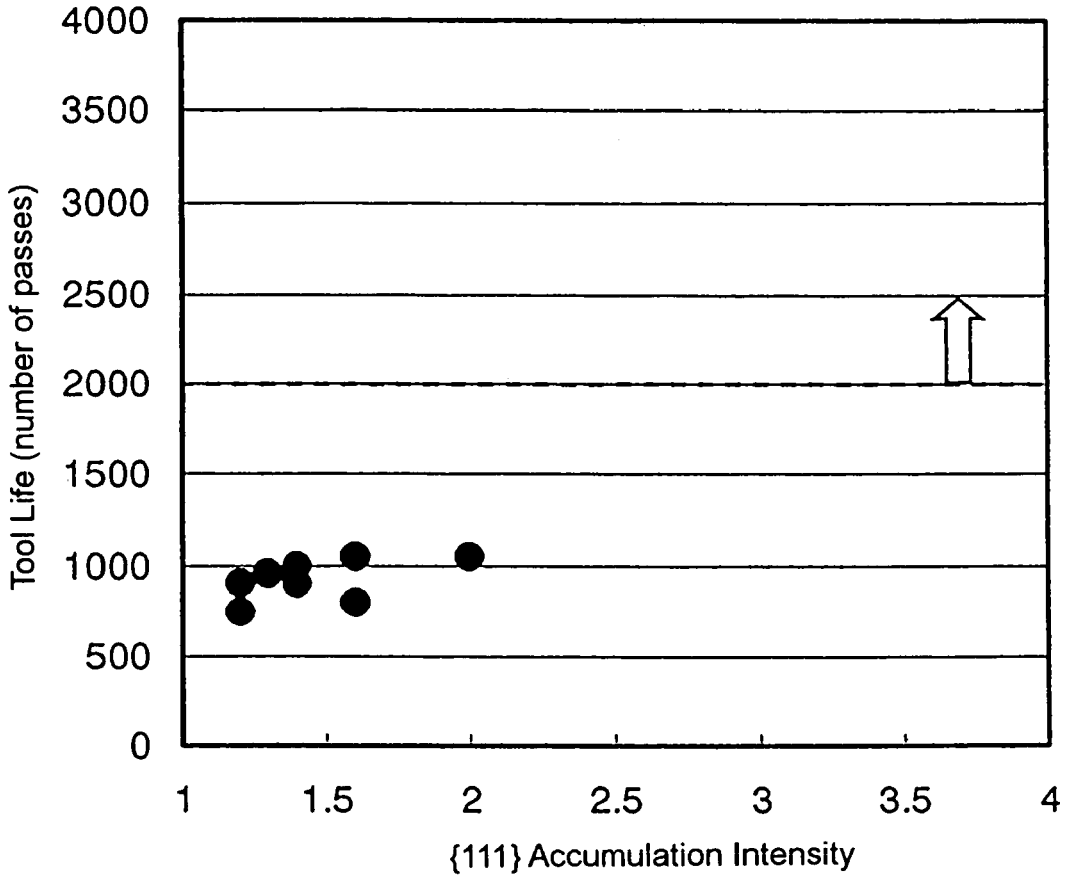
FIG. 3 is a diagram showing a relationship between a tool life and an accumulation intensity of {111} face onto "the plane in parallel with the circumferential direction of steel tube".

In Tables 5-7, above texture and tool life are listed together. And the relationship between an accumulation intensity and a tool life is shown in FIGS. 2 and 3 respectively.

FIG. 2, as afore-mentioned, is a diagram showing a relationship between a tool life and an accumulation intensity of {211} face in the plane in parallel with the circumferential direction of steel tube. Further, FIG. 3 is a diagram showing a relationship between a tool life and an accumulation intensity of {111} face onto the plane in parallel with the circumferential direction of steel tube.

From above Tables 5-7, it is obvious that either Test No. conforming to the specified provisions according to the present invention exhibits an excellent tool life extending to 2000 passes or more, thereby indicating that excellent machinability is attained. On the other hand, in case either Test No. that does not conform to the specified provisions according to the present invention, the tool life turned out to be less than 2000 passes, thus resulting in poor machinability.

EXAMPLE 2

Similarly to Test Nos. 47 and 59 in Example 1, the steel tubes after heat treatment are prepared. Namely, the steel tubes of 45.0 mm in diameter by 4.51 mm in thickness after hot tube making, are subjected to afore-mentioned spheroidizing annealing, descaling by acid pickling, and then cold rolling with Cold Pilger mill to obtain the dimension of 30.0 mm in diameter by 3.0 mm in thickness, which are subsequently followed by heat treatment at 700° C. for 30 min duration, thus being prepared as the steel tubes for Steels D and H. By using these steel tubes, a cutting-machining test for a tool life in terms of groove-cutting onto the outer surface under the same conditions for Example 1, except the change of coating layer onto the "chip", is carried out.

There are two types of coating layer onto relief face only of afore-mentioned "chip", which are "TiAlN" and "a multi-laminated coating layer by depositing TiN and AlN alternately with a cycle of 2.5 nm", each Vicker's Hardness of which is 3100 and 3900 respectively.

Table 8 and FIG. 6 show a tool life in machinability test. The results of Test Nos. 47 and 59 in Example 1, namely each tool life in case of cutting-machining with a chip where TiN coating is provided solely onto relief face, are also included in Table 8 and FIG. 6. As afore-mentioned, {211} accumulation intensity and {111} accumulation intensity denote an accumulation intensity of {211} face and that of {111} face respectively.

It is evident, from what Table 8 and FIG. 6 show, that the tool life was markedly improved when Vicker's Hardness of coating layer is 3000 or more.

TABLE 8

| | | | | | Cold Working | | | | |
|---|---|---|---|---|---|---|---|---|---|
| | | | Dimension after Hot Tube Making | | | Dimension after Cold Working | | | |
| Classification | Test No. | Steel | Outside Diameter (mm) | Wall Thickness | Method | Outside Diameter (mm) | Wall Thickness | Cross-section Reduction Rate (%) | Wall Thickness Reduction Rate (%) |
| I | 47 | D | 45.0 | 4.51 | Rolling | 30.0 | 3.0 | 55.6 | 33.5 |
| I | 73 | D | 45.0 | 4.51 | Rolling | 30.0 | 3.0 | 55.6 | 33.5 |
| I | 74 | D | 45.0 | 4.51 | Rolling | 30.0 | 3.0 | 55.6 | 33.5 |
| I | 59 | H | 45.0 | 4.51 | Rolling | 30.0 | 3.0 | 55.6 | 33.5 |
| I | 75 | H | 45.0 | 4.51 | Rolling | 30.0 | 3.0 | 55.6 | 33.5 |

TABLE 8-continued

| | | | | | | | | | |
|---|---|---|---|---|---|---|---|---|---|
| I | 76 | H | 45.0 | 4.51 | Rolling | 30.0 | 3.0 | 55.6 | 33.5 |

| | Heat Treatment | | Texture | | | Cutting-Machining Test | | |
|---|---|---|---|---|---|---|---|---|
| | Heating | | Face | {211} | {111} | Coating Layer onto Relief Face of Chip | | Tool Life |
| Classification | Temperature (° C.) | Duration (min) | Orientation random | Accumulation Intensity | Accumulation Intensity | Type | Hv Hardness | (number of passes) |
| I | 700 | 30 | {211} | 1.7 | 0.7 | (1) | 2200 | 2050 |
| I | 700 | 30 | {211} | 1.7 | 0.7 | (2) | 3100 | 2800 |
| I | 700 | 30 | {211} | 1.7 | 0.7 | (3) | 3900 | 4200 |
| I | 700 | 30 | {211} | 2.8 | 0.5 | (1) | 2200 | 2650 |
| I | 700 | 30 | {211} | 2.8 | 0.5 | (2) | 3100 | 3300 |
| I | 700 | 30 | {211} | 2.8 | 0.5 | (3) | 3900 | 4100 |

I and C in Classification column denote "Inventive Example" and "Comparative Example" respectively.

Rolling in Cold Working column means cold rolling with Cold Pilger mill.

In the column of the type of coating layer onto relief face of chip, (1) denotes "TiN", (2) denotes "TiAlN" and (3) denotes "a multi-laminated coating layer by depositing TiN and AlN alternately wit a cycle of 2.5 nm".

A symbol * denotes the deviation from the specified provisions by the present invention.

A symbol # denotes that the target is not cleared.

EXAMPLE 3

The steel with chemical compositions shown in Table 9 is melted and the seamless tubing material for cold working is prepared by Mannesmann process. The tubing material thus made is subjected to spheroidizing annealing and then cold working. After cold working, straightening is performed either without heat treatment or subsequent to heat treatment to prepare steel tubes for testing. The steel tubes thus obtained are subjected to cutting-machining test to measure a tool life.

TABLE 9

| Chemical Compositions (mass %) Balance; Fe and Impurities | | | | | | | | | | |
|---|---|---|---|---|---|---|---|---|---|---|
| C | Si | Mn | Cr | Mo | Al | Ti | P | S | N | O |
| 1.00 | 0.23 | 0.33 | 1.38 | 0.03 | 0.022 | 0.0014 | 0.008 | 0.005 | 0.0055 | 0.0007 |

In hot tube making, Mannesmann Mandrel mill is utilized to make tubes of 60 mm in diameter by 7.0 mm in thickness, which are subsequently cooled in the open air after hot tube making process. The steel tubes thus made are subjected to spheroidizing annealing, subsequent descaling by acid pickling and lubrication treatment by an ordinary method, and then cold drawing with cross-section area reduction rate of 29% to the dimension of 50 mm in diameter by 6.0 mm in thickness.

After cold working, straightening is performed either without heat treatment or subsequent to heat treatment. Where the heat treatment is performed, the condition of soft annealing comprises the heating temperature at 640° C. and holding time of 10 min. and a 2-2-2-1 cross roll type straightening machine is used for straightening.

Similarly to Example 1, the steel tubes thus straightened are subjected to cutting-machining test for measuring a tool life in terms of groove-cutting under the conditions that a chip shown in (i) below is used and machining parameters shown in (ii) below are applied. In this regard, the pass when the amount of wear on relief face of the chip reaches no less than 100 μm or the tip of the chip comes off is sentenced to be the tool life. Incidentally, the target of tool life is set to be 2000 passes or more in terms of a number of passes.

(i) Chip: The grade of the base metal is K10 grade of cemented carbides, and TiN coating (the hardness of the coated layer is 2200 in Vickers Hardness) is applied on relief face only, wherein the rake angle is 10 degree, which is used for cutting the groove with 2.00 mm width and 0.1 mm of corner radius.

(ii) Cutting parameter: The parameter in cutting comprises the circumferential speed: 120 m/min, the feed rate: 0.050 mm per revolution, and the groove depth: 1.2 mm, which is defined as one pass, and repeated passes are applied.

Further, test specimens (10 mm×2.5 mm) for Charpy Impact test are prepared from the steel tubes after straightening, having 2 mm V notch placed in L direction Longitudinal direction of the tube), and the impact properties at ambient temperature is measured. At the same time, the texture is measured under the same conditions with that for Example 1, which is listed in Table 10 along with above impact properties.

TABLE 10

| | Cold Working | | Measurement Result | | |
|---|---|---|---|---|---|
| Test No. | Dimension after Cold Working | Heat Treatment after Cold Working | {211} Accumulation Intensity | Impact Value at Ambient Temperature ($J/cm^2$) | Tool Life (number of passes) |
| 77 | 50 × 6.0 | No | 1.8 | 6 | 3,200 |
| 78 | 50 × 6.0 | Yes | 1.4 | 22 | 1,400 |

From the result shown in Table 10, in case the impact property at ambient temperature is as low as 10 $J/cm^2$ or less (Test No. 77), the tool life is remarkably improved, thus resulting in enhancing machinability enormously.

INDUSTRIAL APPLICABILITY

Steel tubes for bearing element parts according to the present invention, wherein the specific compositions are limited and an accumulation intensity of {211} face along with an impact property at ambient temperature in the longitudinal direction of steel tube are specified, can be provided as a source material for bearing element parts, which have excellent machinability and fatigue life in rolling contact, being incorporated without adding a free-cutting element specifically nor without reducing productivity since the spheroidizing for the same annealing duration with that of conventional spheroidizing treatment can be applied. Accordingly, by applying a manufacturing method or a cutting-machining method according to the present invention, bearing element parts such as races, rollers and shafts can be produced with less cost and efficiently. Thus, the present invention can be widely applied in many fields for use of bearing in various industrial machineries, automobiles and the like.

What is claimed is:

1. A steel tube for bearing element parts, comprising, in mass %, C: 0.6-1.1%, Si: 0.1-1.5%, Mn: 0.2-1.5%, Cr: 0.2-2.0%, S: 0.003-0.020%, Al: 0.005-0.05%, Mo: 0-0.5%, Ni: 0-1%, Cu: 0-0.5%, V: 0-0.1%, Nb: 0-0.05%, Ca: 0-0.003%, Mg: 0-0.003%, and the balance of Fe and impurities that are consisted of Ti: 0.003% or less, P: 0.02% or less, N: 0.012% or less and O (oxygen): 0.0015% or less, wherein the accumulation intensity of {211} face is 1.5 or more in the plane in parallel with the circumferential direction thereof.

2. A steel tube for bearing element parts according to above claim 1, comprising at least Mo of 0.03 mass %.

3. A steel tube for bearing element parts according to above claim 1, wherein an impact value in the longitudinal direction thereof at ambient temperature is 10 $J/cm^2$ or less.

4. A method of manufacturing said steel tube for bearing element parts according to above claim 1, the method comprising the steps of spheroidizing annealing after hot rolling process;

successive cold working in such a way that the cross-section area reduction rate of steel tube is in the range of 50-80% and the wall thickness reduction rate thereof is in the range of 30-50%; and heat treating where heating temperature is in the range of 680° C. and $A_1$ point and the duration is 5-40 minutes, here, $A_1$ point designates the value expressed by the formula as below, where the symbol of the metal element in it means the content, mass %, in the steel $$A_1 \text{ point } (^\circ \text{C.}) = 723 + 29\,\text{Si} - 11\,\text{Mn} + 17\,\text{Cr}.$$

5. A method of machining the steel tube for bearing element parts according to claim 1, wherein a cemented carbide chip with a coating layer having 3000 or more in Vicker's Hardness is applied.

6. A steel tube for bearing element parts according to above claim 2, wherein an impact value in the longitudinal direction thereof at ambient temperature is 10 $J/cm^2$ or less.

7. A method of manufacturing said steel tube for bearing element parts according to above claim 2, the method comprising the steps of spheroidizing annealing after hot rolling process;

successive cold working in such a way that the cross-section area reduction rate of steel tube is in the range of 50-80% and the wall thickness reduction rate thereof is in the range of 30-50%; and heat treating where heating temperature is in the range of 680° C. and $A_1$ point and the duration is 5-40 minutes, here, $A_1$ point designates the value expressed by the formula as below, where the symbol of the metal element in it means the content, mass %, in the steel $$A_1 \text{ point } (^\circ \text{C.}) = 723 + 29\,\text{Si} - 11\,\text{Mn} + 17\,\text{Cr}.$$

8. A method of machining the steel tube for bearing element parts according to claim 2, wherein a cemented carbide chip with a coating layer having 3000 or more in Vicker's Hardness is applied.

* * * * *